US005424718A

United States Patent [19]

Müller et al.

[11] Patent Number: 5,424,718

[45] Date of Patent: Jun. 13, 1995

[54] IR INTRUSION DETECTOR USING SCATTERING TO PREVENT FALSE ALARMS

[75] Inventors: Kurt Müller, Stäfa; Martin Allemann, Hinwil; René Lange, Hombrechtikon, all of Switzerland

[73] Assignee: Cerburus AG., Männedorf, Switzerland

[21] Appl. No.: 216,677

[22] Filed: Mar. 23, 1994

[30] Foreign Application Priority Data

Mar. 26, 1993 [CH] Switzerland ..... 00936/93

[51] Int. Cl.[6] ..... G08B 13/191

[52] U.S. Cl. ..... 340/567; 250/338.3; 250/340; 340/600

[58] Field of Search ..... 340/567, 600; 250/338.3, 340

[56] References Cited

U.S. PATENT DOCUMENTS

B1 3,703,718 4/1982 Berman ..... 340/567
4,307,388 12/1981 Doenges et al. ..... 340/600
4,321,594 3/1982 Galvin et al. ..... 340/567
4,342,987 8/1982 Rossin ..... 340/567
5,055,685 10/1991 Sugimoto et al. ..... 250/342

FOREIGN PATENT DOCUMENTS 680687 10/1992 Switzerland .

*Primary Examiner*—Glen Swann
*Attorney, Agent, or Firm*—Brumbaugh, Graves, Donohue & Raymond

[57] ABSTRACT

An infrared intrusion detector uses infrared-sensitive sensors with pyroelectric sensor elements for detecting infrared radiation from a spatial region to be monitored. Infrared radiation passes through an entrance window and reaches the sensor elements via focusing mirrors. Extraneous radiation, outside the useful radiation band, is eliminated by filtering at the entrance window and by an optical transmission filter, and by scattering at suitable rough surfaces of the focusing mirrors. As a result, the infrared intrusion detector is less sensitive to extraneous radiation and less likely to produce false alarms.

7 Claims, 1 Drawing Sheet

IR INTRUSION DETECTOR USING SCATTERING TO PREVENT FALSE ALARMS

BACKGROUND OF THE INVENTION

The invention relates to intrusion detectors or alarms and, more particularly, to infrared intrusion detectors.

Infrared intrusion detectors are used for the detection of persons or objects moving in a spatial region, by sensing infrared radiation from the persons or objects. Such detectors include one or more infrared sensors, each with two or more pyroelectric sensor elements, which emit an electrical signal with changing incident infrared radiation. The infrared radiation from the spatial region to be monitored passes through an infrared-permeable entrance window into the detector housing and is focused by optical focusing elements onto the infrared sensor elements. Typically, the optical focusing elements are concave mirrors with a plurality of mirror surfaces, or Fresnel lenses at the entrance window. Typically also, the sensor elements are connected differentially in pairs, in order to compensate for the thermal effects of air flows over the sensors or the entrance window.

In order to distinguish infrared radiation from warm bodies from extraneous radiation at other wavelengths, e.g., from visible light from automobile headlights, and thus to guard against false alarms, infrared intrusion detectors are provided with various optical filters. The insensitivity of infrared intrusion detectors to extraneous light is verified by official testing authorities, e.g., by the Association of Property Insurers in the Federal Republic of Germany.

U.S. Pat. No. 3,703,718 discloses an infrared intrusion detector with an optical filter between the focusing mirror and the infrared sensor. The filter transmits radiation in the useful band of 4.5 to 20 micrometers, i.e., the typical body radiation of living organisms. In such a detector, the optical filter may heat up due to absorbed radiation, and may emit secondary radiation in the useful band. This secondary radiation can reach the sensor and trigger a false alarm.

U.S. Pat. No. 5,055,685 discloses an infrared intrusion detector in which secondary radiation from the irradiated optical filter is less likely to trigger a false alarm. An infrared filter is spaced from the infrared sensor element by a sufficient distance, to equalize the intensity of secondary radiation on the two infrared sensor elements from the filter. The resultant difference signal is then approximately zero.

For avoiding false alarms due to extraneous light, Swiss Patent Document 680,687 discloses an entrance window of an infrared intrusion detector which further serves as infrared filter. The window comprises a polyethylene foil in which zinc sulphide particles having a particle size of 0.5 to 50 micrometers are uniformly distributed. The window has high optical transmittance in the wavelength range from 4 to 15 micrometers. Extraneous light, in the visible and near-infrared range, is scattered by the zinc sulphide particles, so that little extraneous light reaches the infrared sensor elements.

Still, these infrared intrusion detectors remain prone to false alarms due to secondary radiation from filters or protective windows, or to heat conducted from the sensor housing to the sensor elements. With increasingly stringent standards to be met, infrared intrusion detectors must be made less likely to produce false alarms due to extraneous light.

SUMMARY OF THE INVENTION

For radiation reaching the infrared sensor elements, an infrared intrusion detector with improved protection against false alarms has an enhanced ratio between the intensity of significant radiation, in the useful band from 6–15 micrometers wavelength, and the intensity of extraneous radiation. False alarms due to secondary radiation and heat conduction are less likely.

In a preferred embodiment, for filtering-out the extraneous light, the infrared intrusion detector has an entrance window and an optical filter which transmit the extraneous light to a reduced extent. Additionally, the detector has mirrors with surfaces which focus the radiation in the useful band onto the sensor elements, but which scatter extraneous radiation. Scattering causes a reduction in the intensity of extraneous radiation on the filter and the sensor housing, and thus also a reduction in the conducted heat and in secondary radiation from the filter and the housing.

DETAILED DESCRIPTION OF PREFERRED EMBODIMENTS

Figure 1:
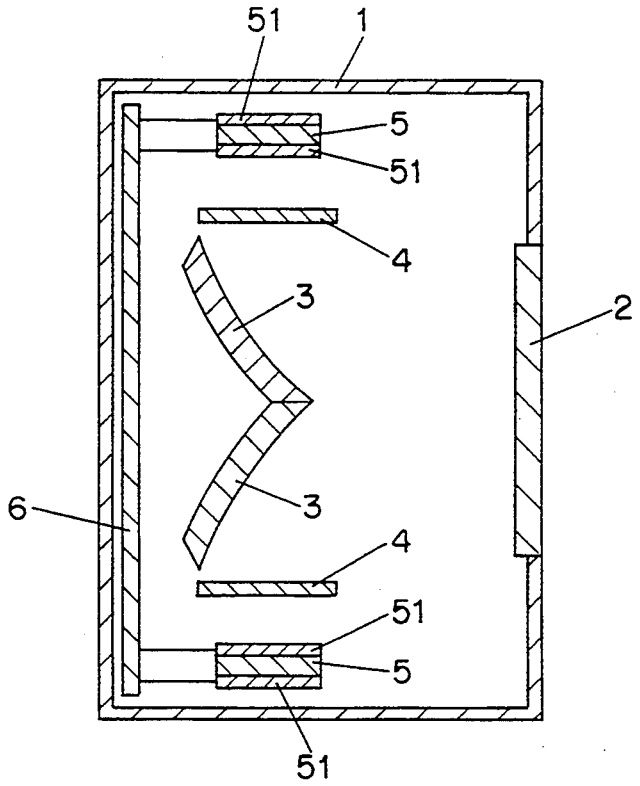
FIG. 1 is a schematic representation of an infrared intrusion detector in accordance with a preferred embodiment of the invention.

FIG. 1 shows housing 1 with infrared-permeable entrance window 2. Disposed in the housing 1 are focusing mirrors 3, optical filters 4, and pyroelectric sensor elements 5 with electrodes 51. The electrodes 51 are connected to evaluation circuitry on a circuit chip 6.

Figure 2:
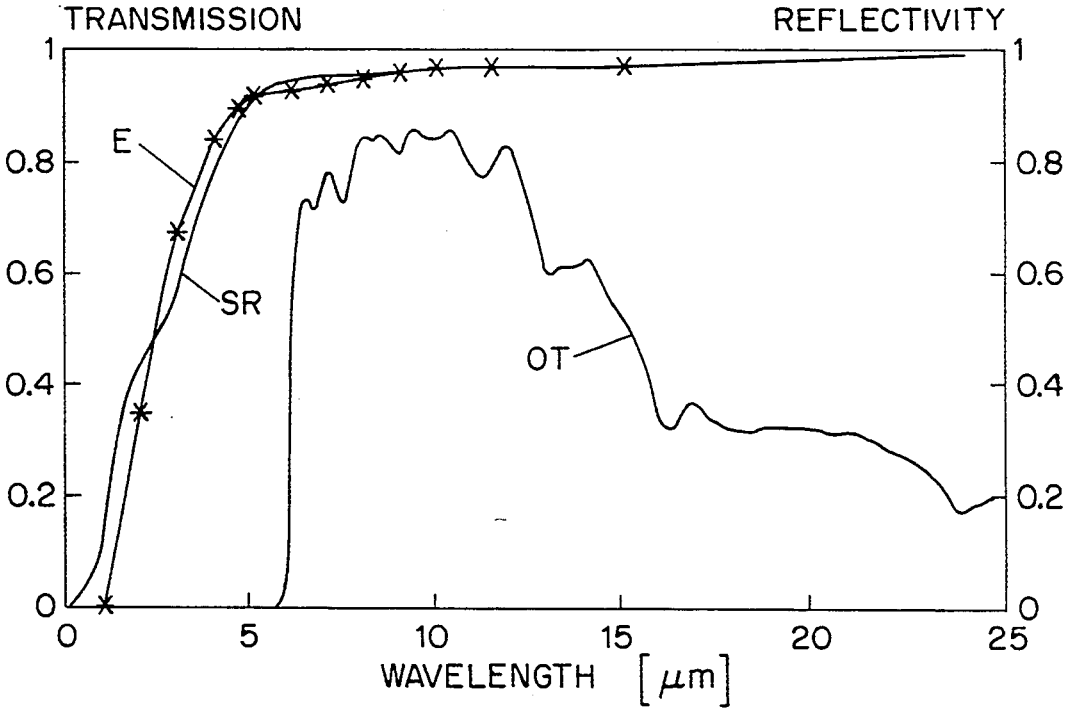
FIG. 2 is a graphic representation, as a function of wavelength, of transmittance of an entrance window (E), of transmittance of an optical transmission filter (OT), and of reflectivity (SR) of a mirror surface in a preferred embodiment of the invention.

In a preferred embodiment of the invention, the focusing mirrors 3 have surface roughness for infrared selectivity. In the wavelength range from 6 to 15 micrometers, the infrared radiation is specularly reflected and focused in accordance with the general shape of the mirror surface. The extraneous radiation, in the visible and near-infrared range from about 0.4 micrometer or less up to 3 micrometers, is diffusely scattered. Curve SR of FIG. 2 represents typical specular reflection of a mirror surface with a rough surface, namely of an ELAMET layer from Gesellschaft für Oberflächentechnik mbH.

Extraneous light, scattered diffusely at the rough mirror surfaces, falls on the optical transmission filter in a low intensity. Thus, the secondary radiation due to absorbed extraneous light is greatly reduced. If some secondary radiation is emitted nevertheless, such radiation falls on the filter with uniform intensity distribution, and thus reaches the sensor elements with uniform intensity distribution also. The resultant difference signal of the two sensor elements is then approximately zero. This applies correspondingly to heating of the sensor elements by heat conduction from the sensor housing.

Preferably, the surface of the focusing mirror has specular reflectivity significantly less than 90% and preferably less than 50% at wavelengths below 3 micrometers, and at least 50% and preferably at least 80% at wavelengths between 6 and 15 micrometers. Preferably also, the ratio between the reflectivity of significant radiation and the reflectivity of extraneous radiation is at least 1.1 . Preferred as mirror materials are layers of aluminum, nickel or chromium on a plastic material.

A randomly rough surface can be produced by various methods. One method involves treatment of an injection molding tool by etching, in which the steel matrix is etched away by approximately one micrometer. Carbide particles in steel, having a diameter of approximately one micrometer, remain after etching and produce the desired surface structure.

Alternatively, a smooth mirror of a plastic material such as ABS (acrylonitrile butadiene styrene copolymer) for example, is etched for a suitable length of time. The resulting rough surface is then coated with a metal layer, galvanically or by vapor deposition. In the case of vapor deposition, the etched surface is precisely replicated. In the case of galvanic deposition, the surface tends to be flattened out again.

A further method for the production of a randomly structured surface involves lustrous chromium plating, by the standard process.

Yet another method involves vapor deposition of aluminum at a rapid deposition rate, as practiced by Gesellschaft für Oberflächentechnik mbH. If the aluminum layer grows to above one micrometer, dendrites are formed on the surface. The resulting surface structure has the desired spectral properties.

In a preferred alternative embodiment of the invention, a mirror has regular, non-random surface structure. The regular structure is produced photolithographically on an injection molding tool insert, e.g., after laser beam inscription. The structure is then given a nickel or chromium coating by vapor deposition. The regular structure is replicated in the injection molding process.

While the above is a description of the invention in preferred embodiments, various modifications, alternate constructions and equivalents may be employed, only some of which have been described above. For example, surface roughness as described for mirror surfaces and as produced, e.g., in an injection molding step as described above may also be used for a surface of the entrance window, for substantially unimpeded transmission of significant radiation and scattering of extraneous radiation. Further alternatives within the scope of the appended claims will be apparent to those skilled in the art.

We claim:

1. An infrared intrusion detector comprising:

a radiation-impermeable housing with an infrared-radiation permeable window;

at least one infrared sensor disposed in the housing, comprising a plurality of pyroelectric sensor elements;

reflector means having a plurality of mirror surfaces for reflecting and focusing infrared radiation entering the housing through the window onto the pyroelectric sensor elements;

filter means for filtering radiation reflected by the reflector means; wherein the mirror surfaces have a surface roughness such that radiation having a wavelength in an approximate range from 6 to 15 micrometers is focused onto the infrared sensor elements, and such that radiation of wavelengths below approximately 3 micrometers is scattered by the mirror surfaces.

2. The infrared intrusion detector of claim 1, wherein the mirror surfaces have surface roughness for specular reflection of at least 50% in the wavelength range from 6 to 15 micrometers, and of less than 90% in an approximate wavelength range from 0.4 to 3 micrometers.

3. The infrared intrusion detector of claim 2, wherein the mirror surfaces have a first specular reflectivity in the wavelength range from 6 to 15 micrometers and a second specular reflectivity in the wavelength range from 0.4 to 3 micrometers such that the first and second reflectivities are in a ratio of at least 1.1.

4. The infrared intrusion detector of claim 1, wherein the mirror surfaces have a regular surface structure.

5. The infrared intrusion detector of claim 4, made by a process comprising:

using laser writing in forming a pattern on a die surface corresponding to the regular surface structure; and injection molding the reflector means in a die comprising the die surface.

6. The infrared intrusion detector of claim 1, wherein a mirror surface material is selected from the group consisting of aluminum, nickel and chromium.

7. The infrared intrusion detector of claim 1, wherein the infrared-radiation-permeable window has a window surface with surface roughness such that radiation in the wavelength range from 6 to 15 micrometers is transmitted substantially unimpeded, and such that radiation in the wavelength range from 0.4 to 3 micrometers is scattered at the window surface.

* * * * *

UNITED STATES PATENT AND TRADEMARK OFFICE

CERTIFICATE OF CORRECTION

PATENT NO. : 5,424,718

DATED : June 13, 1995

INVENTOR(S) : Müller et al.

It is certified that error appears in the above-indentified patent and that said Letters Patent is hereby corrected as shown below:

Title page, Item 73, "Cerburus AG" should read --Cerberus AG--.

Signed and Sealed this

Seventeenth Day of October, 1995

*Attest:*

*Attesting Officer*

BRUCE LEHMAN

*Commissioner of Patents and Trademarks*